United States Patent [19]

Brinton

[11] 4,088,090

[45] May 9, 1978

[54] ENGINE WATER-TIGHTING DEVICES

[75] Inventor: Michael Brian Jervis Brinton, Dorset, England

[73] Assignee: RNLI (Trading) Limited, Dorset, England

[21] Appl. No.: 757,093

[22] Filed: Jan. 5, 1977

[30] Foreign Application Priority Data

Jan. 5, 1976 United Kingdom ..... 210/76

[51] Int. Cl.[2] ..... B63H 21/26

[52] U.S. Cl. ..... 115/17

[58] Field of Search ..... 115/74, 75, 76, 6.1, 115/17, 70, 73; 114/16.4; 9/9; 128/145 A; 137/38

[56] References Cited

U.S. PATENT DOCUMENTS

| | | | |
|---|---|---|---|
| 2,352,898 | 7/1944 | Hill | 137/38 |
| 2,814,292 | 11/1957 | Girden | 128/145 A |
| 3,113,550 | 12/1963 | Omer | 115/70 |
| 4,003,331 | 1/1977 | Brinton | 115/17 |

*Primary Examiner*—Allen N. Knowles
*Assistant Examiner*—Edward M. Wacyra
*Attorney, Agent, or Firm*—Rose & Edell

[57] ABSTRACT

An air intake water-tighting device is provided for a marine outboard motor for closing the intake automatically to prevent the ingress of water in the event of a capsize of the craft to which the outboard motor is fitted. The device consists of a valve casing adapted to fit over the engine air intake, a ported sleeve fixed in the valve casing, a rotary ported barrel fitted to swivel inside the sleeve, and an air inlet trunk outside the valve and fixed to one end of the barrel which air inlet trunk is so weighted that it turns the barrel through approximately 180° in the sleeve in the event of a capsize and thereby moves the ports in the sleeve and barrel angularly out of register.

3 Claims, 3 Drawing Figures

ENGINE WATER-TIGHTING DEVICES

This invention relates to engine water-tighting devices. More particularly, it concerns the water-tighting of outboard motor air intake ports such as are usually provided in the motor cover of certain marine outboard motors, especially 50 h.p. and 55 h.p. motors, in the event of capsize of the powered craft.

When a craft powered by an outboard motor or motors capsizes, water enters each engine air intake. This prevents the engine being restarted immediately if the boat is righted and may also cause corrosion damage to the engine. It is therefore an object of the invention to provide a remedy for this, suitable particularly for 50 h.p. and 55 h.p. "Evinrude" and "Johnson" motors.

According to the present invention, there is provided on the engine air intake a weight-operated swivel inlet valve that is open when the boat is running normally but closes under gravity in the event of a capsize.

One arrangement according to the invention, for 55 h.p. outboard motors, is shown by way of example in the accompanying drawings, in which.

Figure 1:
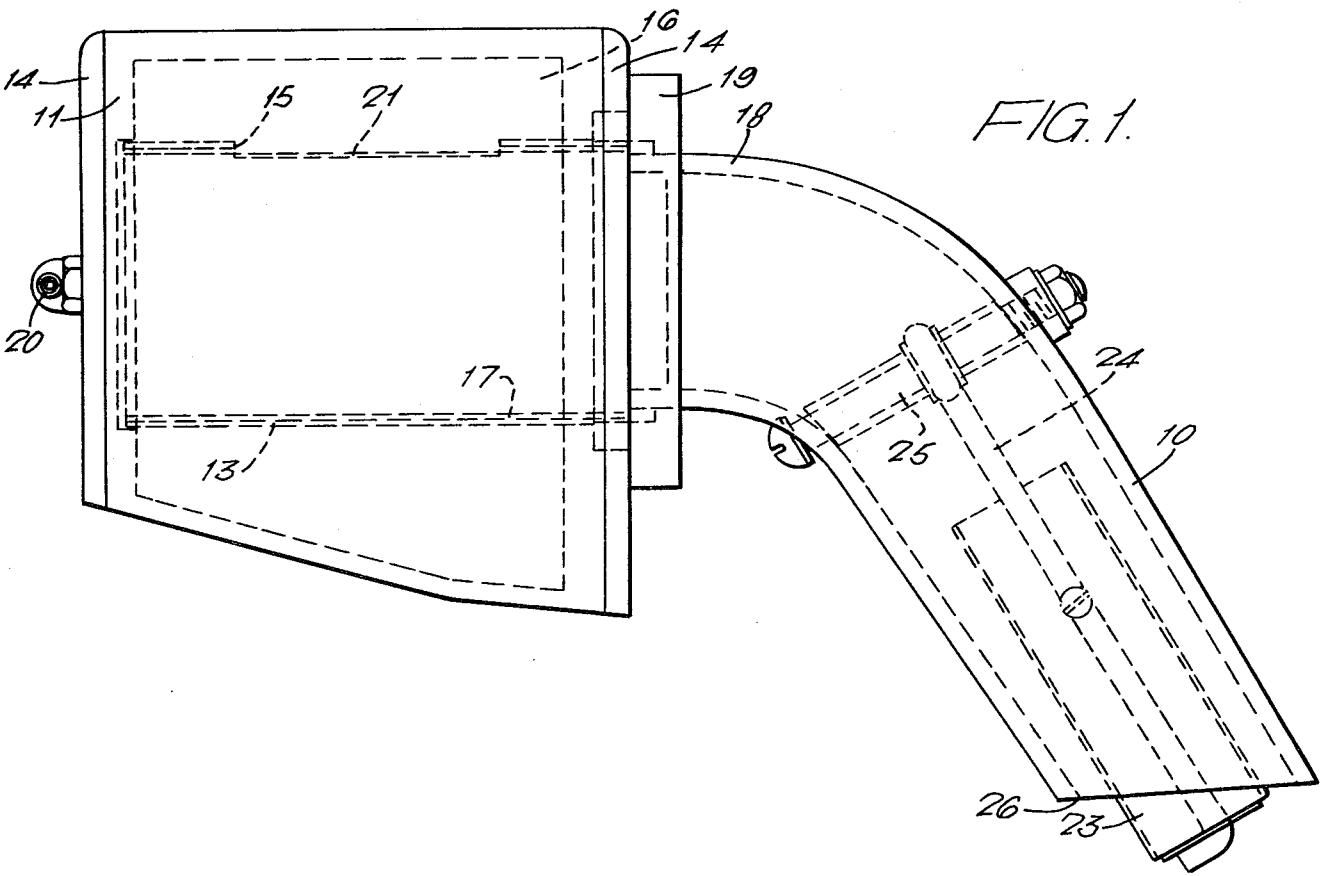
FIG. 1 shows an engine air intake valve in side elevation.
Figure 2:
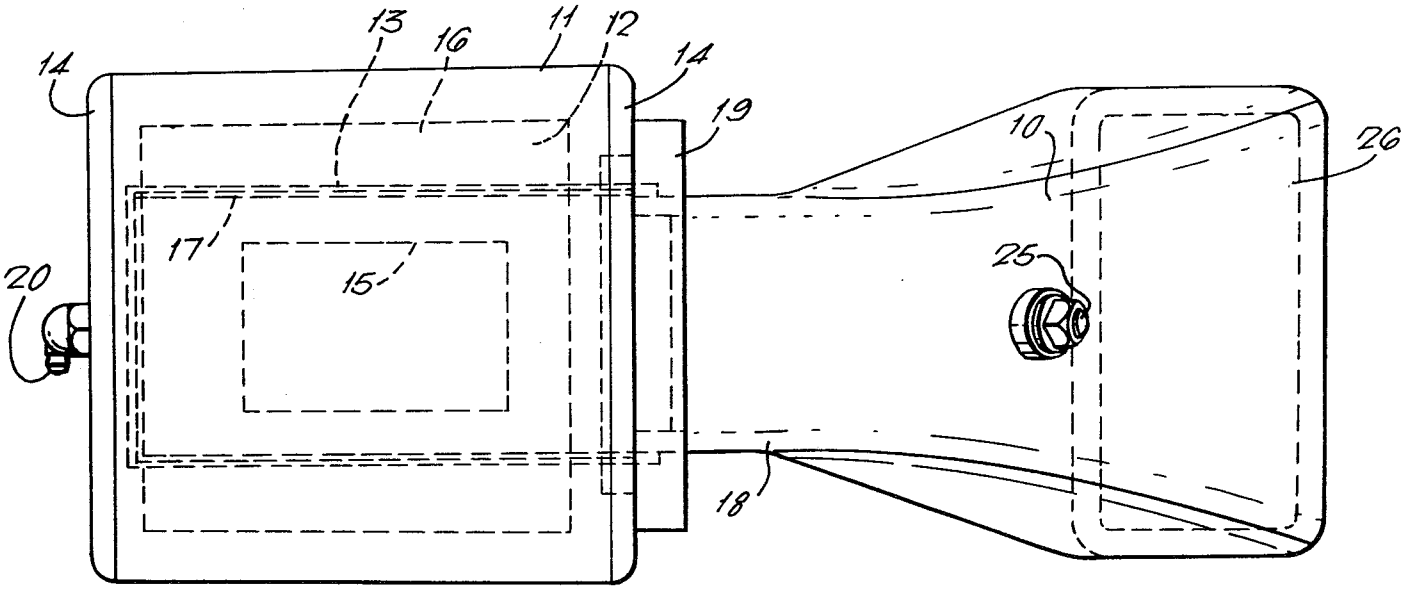
FIG. 2 is a plan view.
Figure 3:
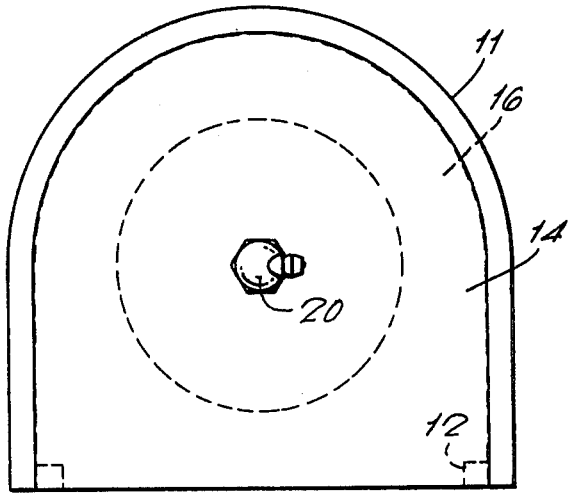
FIG. 3 is an elevation showing the forward end of the valve casing.

The assembly shown in the drawings comprises a water-tight valve casing 11 which is open at the bottom where it is contoured to fit on to the motor cover of an outboard motor to enclose the existing air intake port. Flanges 12 at the bottom periphery of the casing 11 receive machine screws for fixing it over the engine air intake. Extending horizontally through the casing 11 between end walls 14 is a fixed machine cylindrical sleeve 13 having a rectangular port 15 cut in the upper region of its cylindrical wall. Surrounding the sleeve 13 within the casing 11 is a plenum or air space 16.

The movable part of the valve consists of a rotary machined barrel 17 that is a sliding fit inside the sleeve 13 of the valve housing, the barrel 17 emerging from the valve housing at one end where it is secured to one end of an air inlet trunk 18 that bends downward and flares out to form an inclined fan-shaped air inlet 10 with a downward facing rectangular mouth 26. The barrel 17 is retained in the sleeve 13 by a removable end plate 19 surrounding the upper end of the air trunk 18 and secured to the end wall of the casing 11 by machine screws. A grease nipple 20 enables the swivel comprising the sleeve 13 and the barrel 17 to be lubricated. The barrel 17 has a rectangular port 21 matching the port 15 in the sleeve 13 and in alignment with it when the engine is upright. In this attitude, air from the inlet trunk 18 passes freely through the ports 15, 21 into the plenum 16 and thence to the engine.

Fitted inside the air inlet 10 is a penduluous weight consisting of a lead-filled tube 23 secured to a steel bar 24 that extends up roughly along the axis of the down-turned portion of the air trunk 18 and has an eye at its upper end that is pivotally mounted on a bolt 25 passing through the trunk 18 so as to be able to swing in an inclined plane approximately parallel to the plane in which the axis of the down-turned portion of the air trunk 18 can swing by reason of the barrel 17 swivelling in the sleeve 13. This enables the pendulous weight 23 to swing relatively to the air inlet to the extent permitted by the confines of the inlet mouth 26. The result is that, due to gravity acting on the weight 23, the inlet pipe 18 always tries to swing into an attitude in which it extends downward from the valve casing 11 regardless of the attitude of the engine. The weight 23 therefore not only causes operation of the swivel valve in the event of a capsize but also keeps the valve from swinging closed due to movements of the craft while in the upright position.

When the engine is mounted on a boat the swivel axis of the valve described extends generally fore and aft. Should the boat capsize the gravity action on the weight in the air trunk 18 will cause the barrel 17 to turn rapidly through roughly 180° in the sleeve 13 thereby moving the port 21 angularly out of register with the port 15. Thus, the valve is closed to prevent the ingress of water to the engine for so long as the engine is inverted. On righting of boat the swivel valve returns to its initial condition so that air can again flow to the engine.

It will be observed that the action of the valve in protecting the engine from ingress of water is in no way dependent on the water pressure or engine suction but is an automatic result of the change of attitude. Should the craft be righted with its stern to a breaking sea, the design of the inlet trunk 18 is such that it will prevent spray from entering the motor cover via the now aligned ports 15, 21.

What is claimed is:

1. An air-intake water-tighting device for an outboard motor including, on the engine air intake, a weight-operated swivel inlet valve that is open when the boat is running normally but closes under gravity in the event of a capsize, said inlet valve comprising a valve casing adapted to fit over the engine air intake, a horizontal sleeve fixed in the valve casing with a plenum or air space within the casing around the sleeve, a horizontal rotary barrel fitted within the sleeve able to rotate about the axis thereof, and an air inlet trunk outside the valve casing secured to one end of the barrel, the air trunk being weighted so that it turns the barrel through approximately 180° in the sleeve in the event of a capsize, and the sleeve and barrel having cooperating ports which are in register when the boat is upright and are moved out of register upon turning of the barrel in the sleeve as aforesaid.

2. A device according to claim 1, wherein the air inlet trunk is down-turned and terminates in a downward-facing air inlet mouth, and a weight in the air trunk serves to swing the air trunk always into approximately the same down-turned attitude, regardless of whether the boat is upright or capsized.

3. A device according to claim 2, wherein the weight is a pendulum within the down-turned portion of the inlet trunk mounted to swing relatively to the inlet trunk, to the extent permitted by the confines thereof, in a plane approximately parallel to the plane of swing of the down-turned portion of the inlet trunk.

* * * * *